US008979242B2

(12) United States Patent
Melde et al.

(10) Patent No.: US 8,979,242 B2
(45) Date of Patent: Mar. 17, 2015

(54) TRAP CONFIGURED TO COLLECT INK PARTICLE CONTAMINANTS IN RESPONSE TO A CLEANING FLOW

(71) Applicant: Palo Alto Research Center Incorporated, Palo Alto, CA (US)

(72) Inventors: Kai Melde, San Francisco, CA (US); John S. Paschkewitz, San Carlos, CA (US); Eric J. Shrader, Belmont, CA (US); Terrance Stephens, Canby, OR (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 13/714,658

(22) Filed: Dec. 14, 2012

(65) Prior Publication Data

US 2014/0168315 A1 Jun. 19, 2014

(51) Int. Cl.

| | |
|---|---|
| ***B41J 2/165*** | (2006.01) |
| ***B41J 2/17*** | (2006.01) |
| ***B41J 2/14*** | (2006.01) |

(52) U.S. Cl.

CPC *B41J 2/1721* (2013.01); *B41J 2/14* (2013.01); *B41J 2002/14419* (2013.01)

USPC ..... 347/29

(58) Field of Classification Search

USPC ..... 347/93

See application file for complete search history.

(56) References Cited

U.S. PATENT DOCUMENTS

| | | | | |
|---|---|---|---|---|
| 2,332,188 | A * | 10/1943 | Andrews | 210/409 |
| 4,346,388 | A * | 8/1982 | Wiley | 347/6 |
| 6,036,299 | A * | 3/2000 | Kobayashi et al. | 347/30 |
| 6,364,466 | B1 | 4/2002 | Chen et al. | |
| 6,669,336 | B1 | 12/2003 | Kneezel et al. | |
| 7,371,330 | B2 | 5/2008 | Ducree et al. | |
| 7,735,954 | B2 | 6/2010 | Xu et al. | |
| 7,946,683 | B2 | 5/2011 | Gao et al. | |
| 8,544,996 | B2 * | 10/2013 | Hays et al. | 347/93 |
| 2006/0261034 | A1 | 11/2006 | Kurashima et al. | |
| 2008/0128332 | A1 * | 6/2008 | Lean et al. | 209/210 |
| 2008/0218552 | A1 * | 9/2008 | Xu et al. | 347/27 |
| 2008/0302732 | A1 * | 12/2008 | Soh et al. | 210/695 |
| 2010/0110155 | A1 * | 5/2010 | Delueg | 347/93 |
| 2010/0186524 | A1 * | 7/2010 | Ariessohn et al. | 73/863.22 |
| 2011/0205267 | A1 * | 8/2011 | Wang | 347/7 |
| 2012/0182352 | A1 | 7/2012 | Fukada et al. | |

FOREIGN PATENT DOCUMENTS

| | | |
|---|---|---|
| EP | 1547775 | 6/2005 |
| GB | 2371023 | 7/2002 |
| JP | 2002210962 | 7/2002 |

* cited by examiner

*Primary Examiner* — Stephen Meier
*Assistant Examiner* — Alexander D Shenderov
(74) *Attorney, Agent, or Firm* — Hollingsworth Davis, LLC

(57) ABSTRACT

An apparatus includes an inkjet manifold with at least one ink supply port coupled to an ink supply and at least one ink delivery port. A flow path is between the ink supply and ink delivery ports, and the flow path includes a trap configured to collect particle contaminants in response to a pulsed cleaning flow and hold the particle contaminants during an operational flow.

19 Claims, 6 Drawing Sheets

TRAP CONFIGURED TO COLLECT INK PARTICLE CONTAMINANTS IN RESPONSE TO A CLEANING FLOW

SUMMARY

Examples described herein are directed to an ink jet manifold. In one embodiment, an apparatus includes an inkjet manifold with at least one ink supply port coupled to an ink supply and at least one ink delivery port. A flow path is between the ink supply and ink delivery ports, and the flow path includes a trap configured to collect particle contaminants in response to a pulsed cleaning flow and hold the particle contaminants during an operational flow.

In another embodiment, a method involves applying a high-flow of ink through a flow path between an ink supply port and an ink delivery port for a first duration. A low-flow of ink is applied through the flow path for a second duration, the flow path including a trap configured to collect particle contaminants in response to the high- and low-flows of the first and second durations. An operational flow is applied through the flow path for printing operations. The trap is configured to hold the particle contaminants during the operational flow.

These and other features and aspects of various embodiments may be understood in view of the following detailed discussion and accompanying drawings.

BRIEF DESCRIPTION OF THE DRAWINGS

The discussion below makes reference to the following figures, wherein the same reference number may be used to identify the similar/same component in multiple figures.

DETAILED DESCRIPTION

The present disclosure relates to inkjet printing devices. Ink jet printers operate by ejecting small droplets of liquid ink onto print media. In some implementations, the ink is ejected directly on a final print media, such as paper. In other implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature allow the ink to be transported and loaded into the ink jet printer in solid form, without the packaging or cartridges typically used for liquid inks.

In a liquid state, ink may contain particle contaminants that can obstruct the passages of the ink jet pathways. For example, ink flow passages may have small bits of metal or plastic residue resulting from manufacturing processes. Other contaminants, such as paper fibers, dust, lubricants, etc., may be introduced during use of the printer. However, once the contaminant particles are introduced, they may lead to reduced image quality and/or device failure. For example, the ink may carry the particles into one or more jets that apply the ink to the target media, and the particles may partially or fully clog the jets.

Embodiments described in this disclosure utilize features to collect and hold contaminant particles before they reach critical ink flow pathways, such as narrow manifold passages, jets, etc. For purposes of the present discussion, the term "manifold" will be used to describe a fluid flow path between a source of ink (e.g., tank, reservoir) and a destination (e.g., jet, orifice). As a result, the embodiments are not intended to be limited to particular manifold embodiments, e.g., fluid paths with multiple input paths and/or multiple output paths. As described hereinbelow, the manifold may have at least one ink supply port coupled to an ink supply and at least one ink delivery port. A port may include any combination of passageway, opening, orifice, permeable member, etc., that fluidly couples one ink passageway to another.

Figure 1:
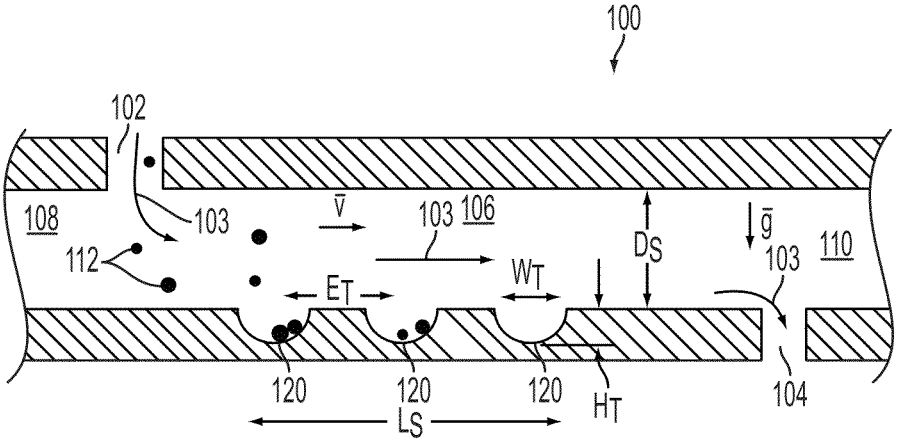
FIG. 1 is a schematic diagram of an inkjet manifold flow path according to an example embodiment.

In reference now to FIG. 1, a block diagram illustrates an inkjet manifold flow path 100 according to an example embodiment. The flow path 100 includes an ink supply port 102 and an ink delivery port 104 fluidly coupled via an elongated passageway 106. Fluid flows between the ports 102, 104 as indicated by arrows 103. The passageway 106 may be open or closed at ends 108, 110. As a result, the flow 103 may be mixed with other flows from one or more ends 108, 110 and/or separated to flow out of one or more ends 108, 110. For purposes of the present discussion, features are included to remove contaminant particles 112 from the flow 103 so that the particles 112 do not enter at least ink delivery port 104.

In the illustrated embodiment, the manifold flow path 100 is oriented so that the gravity field vector g is pointing downwards. Due to the effects of buoyancy, if the particles are heavier than the fluid in passageway 106, particles 112 will sink to the bottom in the absence of any other forces acting on the particles 112. Flow 103 of ink will also exert a force on the particles 112, resulting in the particles 112 traversing the passageway 106 from left to right, as well as downward due to the acceleration of gravity.

In order to prevent the particles 112 from entering the ink delivery port 104, the passageway 106 may include one or more traps 120. In this example, the traps 120 are configured as depressions in a wall of the passageway 106, although in other examples shown herein a protrusion into the passageway 106 may also serve as a trap. To ensure particles 112 are collected in the traps 120, a pulsed cleaning flow may be applied to ink traveling through the passageway.

The pulsed cleaning flow may include a high-flow that facilitates moving the particle contaminants 112 along the passageway 106 to the traps 120. Afterwards, the pulsed flow includes a low-flow (e.g., zero flow velocity, or a negative or positive flow at or close to zero velocity) portion that facilities the particle contaminants 112 moving into the traps 120 by sedimentation. For example, the high flow may be maintained for a duration $t_H$ that causes a substantial number of particles 112 to be moved along a sedimentation length $L_S$, which in one embodiment may be considered a distance of a region between a fluid transition location (e.g., ink supply port 102) to another fluid transition location (e.g., ink delivery port 104) that is equipped with one or more traps 120.

The duration $t_H$ should generally be shorter than the time that is needed to clear the sedimentation length $L_S$ to allow all particles 112 in the volume above the trap 120 to move into the trap 120. For laminar flow, $t_H<L_S/v_{max}$ with $v_{max}=2*v_{avg}$, where $v_{max}$ is maximum flow velocity at the center of passageway 106 and $v_{avg}$ is the flow velocity averaged across $D_S$. The low-flow may be maintained for a duration $t_L$ that ensures the particles sink by a sedimentation distance $D_S$, which in this example is a height of the passageway 106. The sequence of high- and low-flows may be repeated as part of a cleaning cycle.

Once particles 112 are in the trap 120, the trap 120 and/or surrounding features of the passageway 106 are designed to ensure the particles 112 do not escape under normal operating conditions. For example, the above-described cleaning cycle may be performed at a final stage of manufacture or distribution (e.g., burn in, test, pre-shipment checkout, setup/integration by a third party, etc.) to clear out any debris from manufacturing processes. Thereafter, the passageway 106 may experience a predictable flow pattern, such as a steady state flow during operation and no flow during idle. The nature of the operational flow, the trap 120 and/or the passageway 106 ensures the particles 112 remain in the trap during operation of the device. For example, the trap width $W_T$ and height $H_T$ may be chosen so that during operational flow there is not sufficient flow going into the trap 120 to lift a particle residing at the bottom of the trap. The cleaning cycle may also be initiated by a user during regular use of the apparatus for purposes such as troubleshooting, maintenance, etc.

It will be understood that the features shown in FIG. 1 may be adapted for particles 112 that are lighter than the ink. In such a case, gravity will cause the ink to displace the particles 112 upwards, pushing them to the top of the passageway 106. In such a case, a trap similar to trap 120 could be placed on the upper wall of the passageway 106. Generally, trap features may be placed on any flow surface towards which particles will migrate under the influence of gravity, or under the influence of any other forces (e.g., centripetal forces).

The size of the trap 120, as well as trap location parameters $L_S$ and $D_S$ may depend on a number of factors, including relative density of the particles to the ink ($P=\rho_p/\rho_i$), particle shape/size ($d_p$), the viscosity and density of the ink, pressure drop between ports 102, 104, roughness of the passageway walls, etc. The last three factors may be generalized by the Reynolds number (Re) of the ink flow 103. Generally, $L_S$ increases with increases in Re, $d_p$, $D_S$, and P where $P<1$. Similarly $L_S$ decreases with increasing P where $P>1$. It is assumed that the above relationships are exhibited for laminar flow The size of the trap 120, as well as trap location and sedimentation length $L_S$ may depend on a number of factors, including available space in the print head manifold design, particle size $d_p$, the viscosity and density of the ink, pressure drop between ports 102, 104, etc. The last three factors may be generalized by the Reynolds number (Re) of the ink flow 103. Generally, the trap width $W_T$ should be at least twice as big as the particle diameter $d_p$ or largest particle dimension. The trap height $H_T$ may be twice the trap width $W_T$ or larger. This ensures that no significant flow enters the trap 120 and suppresses secondary circulations and thereby keeps particles in the trap 120. Since increasing $L_S$ allows a longer high flow pulse duration $t_H$, it should be as long as possible, for example extending the entire length of the manifold. In some applications, e.g., retrofit of existing designs, the manifold length (and other dimensions) may be fixed. In such a case, a value of $L_S$ may be made using existing dimensions, and this will guide selection of both trap location and pulse times to ensure particles will get trapped.

Because it is possible that the particles 112 may have a variety of sizes, shapes, and densities, there may be a range of pulse durations that are required to capture a significant amount of the particles 112. In such a case, the value of $t_L$ may be fixed to a maximum value, and a plurality of traps 120 can be placed alongside the passageway to collect the varied population of particles 112. The distance between adjacent traps $E_T$ may be minimized to increase the active trapping surface.

Figure 2:
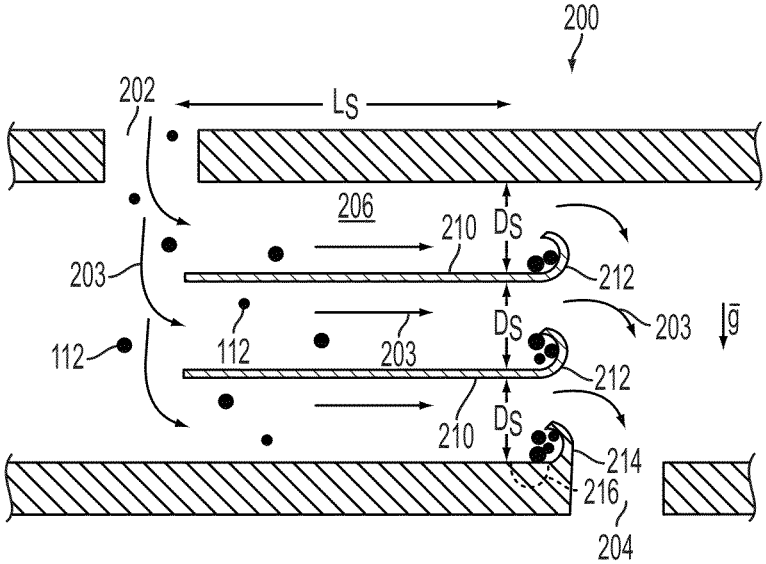
FIG. 2 is a schematic diagram of an inkjet manifold flow path using elongated ridges according to an example embodiment.

In some situations, the dimensional requirements of the passageway 106 may be such that no value of $D_S$ and $L_S$ can be found that result in a significant amount of the particles 112 settling into a surface-mounted trap. In reference now to FIG. 2, a block diagram illustrates features that can be used to reduce sedimentation distance $D_S$ according to an example embodiment. Similar to FIG. 1, a manifold flow path 200 in FIG. 2 includes an ink supply port 202 and an ink delivery port 204 fluidly coupled via an elongated passageway 206. Fluid flows between the ports 202, 204 as indicated by arrows 203.

In this example the left-to-right distance between ports 202, 204 and the height of the channel may be such that placing a trap on the bottom of the passageway 206 may be ineffective. For example, the height of the passageway 206 may be too large for particles 112 to settle for a reasonable amount of time during a cleaning cycle. As a result, the manifold flow path 200 may include one or more elongated ridges 210, each having a trapping member 212 at a downstream end.

In this example, the trapping members are cupped members, with the inside of the cups facing the flow 203. A similar trapping member 214 may be included on the walls of the passageway 206. The wall and/or ridges 210 may also have depressions configured as trapping members (e.g., dashed line 216) in addition to or instead of the cupped members 212, 214. In such a case, the cupped members 212, 214 may serve to block particles 112 during a high flow cycle, where they then settle in the depressions during the low flow cycle. The influence of gravity can thereafter hold some or all the trapped particles in the depression 216 during operational flows.

The elongated ridges 210 may be spaced so that there is a minimum $D_S$ between each of the ridges 210 and between the ridges 210 and walls of the passageway 206. In this way, the time it takes for the particles 112 to settle can be reduced. It will be understood that the spacing between ridges 210 and/or passageway walls need not be distributed evenly. It may be desirable in some embodiments to vary the spacing if it is found that heavier particles favor one path and lighter particles favor another path. While a similar result might be obtained by adding more ridges 210 using a smaller spacing, reducing the number of ridges 210 may have advantages such as reducing flow resistance, ease of manufacture, reducing total height of the passageway 206, etc.

Figure 3:
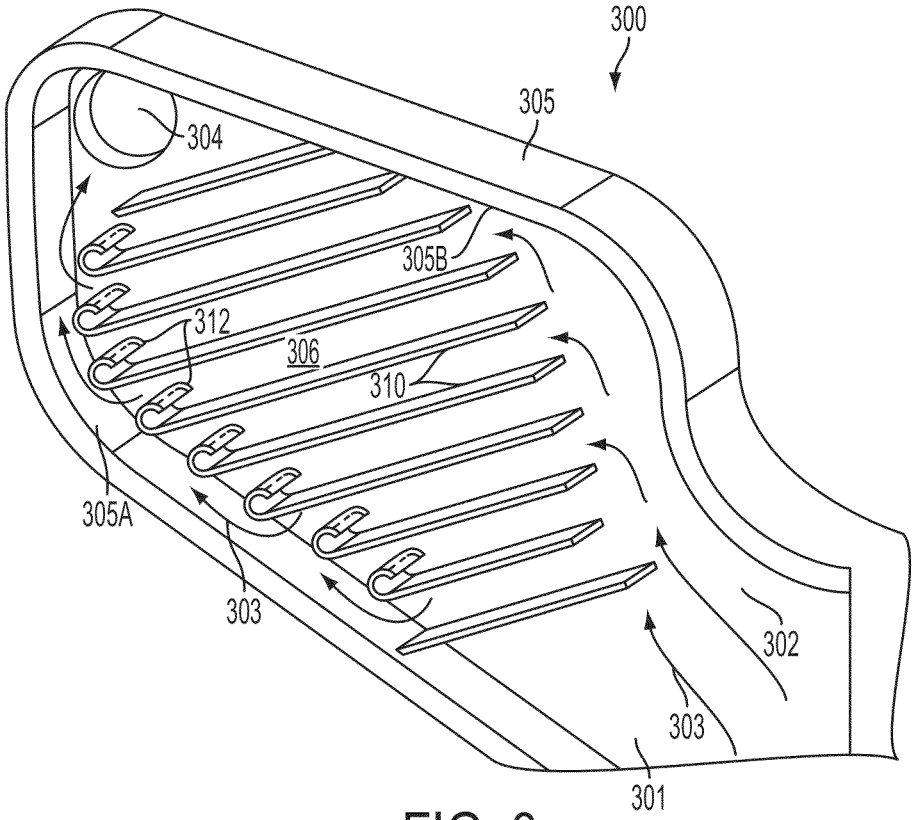
FIG. 3 is a perspective view of an inkjet manifold flow path using elongated ridges according to another example embodiment.

In reference now to FIG. 3, a perspective view illustrates a manifold flow path 300 according to another example embodiment. In this example, the manifold flow path 300 is generally planar, in that flow (indicated by arrows 303) moves between two planar surfaces (only planar surface 301 is shown) surrounded by edge wall 305, the planar surfaces having significantly more surface area exposed to the flow 303 than the edge wall. While the flow path 300 is described as "planar", the concepts described regarding the flow path 300 may be extended to any parallel or non-parallel three-dimensional flow surfaces enclosed by edges forming a flow path such that a fluid flows at least between the flow surfaces.

The manifold flow path 300 includes an ink supply port 302 and an ink delivery port 304 fluidly coupled via passageway 306. The passageway 306 includes a plurality of elongated ridges 310 disposed along the direction of flow. Each elongated ridge 310 has a trapping member 312 at a downstream end. In this example, the elongated ridges 310 are substantially non-parallel to the edge walls, and substantially non-parallel to a direct path between ports 302, 304. There are gaps between upstream ends of the elongated ridges 310 and edge wall 305, and gaps between the trapping members 312 and the edge wall 305. As a result, the elongated ridges divert the direction of the flow 303 between ports 302, 304.

The manifold passageway 300 may include other trapping features not shown in FIG. 3, but described elsewhere herein. For example, the trapping members 312 may encompass depressions and/or voids in the planar surface 301. Depending on the orientation of the flow path 300 relative to gravity, such depressions/voids may facilitate holding particles stopped/trapped by the trapping members 312. Inner surfaces of sidewall 305 (e.g., at locations 305A and 305B) may also include depressions/voids for trapping particles. If voids are used, the voids may join with a secondary flow path, reservoir, chamber, etc., that holds trapped particles and prevents them from being reintroduced into the ink flow path 306.

In various embodiments, it may be desirable to influence the movement of contaminant particles in a particular direction without significantly blocking or changing the ink flow path. For example, the elongated ridges 310 may be oriented generally parallel to a direct line drawn between ports 302, 304 to minimize redirection of flow 303. However this may not significantly change the direction of the particles, which will generally move with the flow 303.

Figure 4:
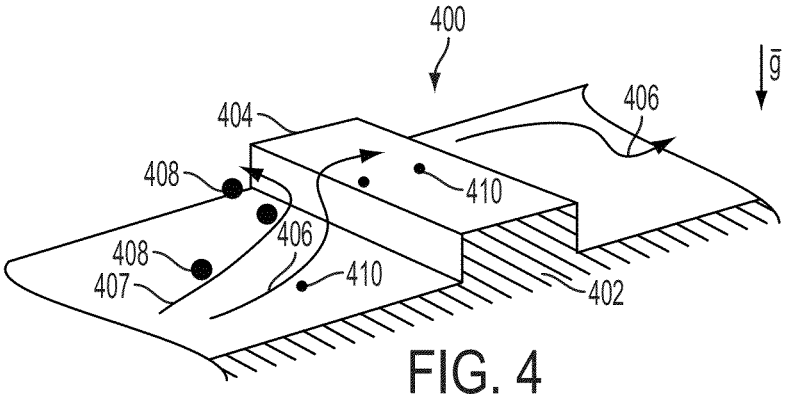
FIG. 4 is a perspective view of a particle guiding feature usable in example flow path embodiments.

In reference now to FIG. 4, a perspective view illustrates a particle guide structure according to an example embodiment. Surface 402 represents a wall/edge of an ink flow path 400. A ridge 404 extends cross-wise relative to a primary flow direction, indicated by arrows 406. The illustrated ridge 404 has a rectangular cross-sectional shape, although alternate cross-sectional shapes (e.g., rounded, sawtooth, etc.) may be used. The height of the ridge 404 may be chosen so that there is enough space between the top of the ridge 404 an upper surface (not shown) of the flow path 400 such that the primary flow 406 is not substantially restricted by the ridge 404. It has been observed that heavier particles (e.g., particles 408) will tend to impact the ridge and be moved in a direction along the ridge 404, as indicated by arrow 407. The influence on direction of particles 408 may be increased by orienting the ridge 404 slightly off-normal to the primary flow 406. Smaller particles (e.g., particles 410) may be carried over the ridge 404, and may be dealt with using downstream features, if needed.

While the ridge 404 may trap some particles, the ridge is generally designed to influence particle movement in a direction different than primary flow 406, e.g., directed to a trapping member for long-term holding. The influencing of particle movement may be due to a combination of impact with the ridge 404, primary flow 406, and gravitational fields or other forces (e.g., centripetal forces). Some guiding trapping features described herein may be configured as minimally intrusive ridges. For example, the elongated ridges 310 shown in FIG. 3 may be configured so that, either along all or part of the length, the ridges do not substantially block spaces between the planar walls (e.g., extend less than 50% between planar walls).

Even without the influence of ridges or the like into a flow path, particles may move in predictable directions due to forces applied by moving flow, gravity, and flow direction changes (e.g., centripetal forces). Accordingly, for a particular flow path, locations for trapping features may be selected to increase the likelihood of catching and holding contaminant particles. For example, FIG. 5 represents a computational fluid dynamics simulation of a manifold path way 500 according to an example embodiment.

Figure 5:
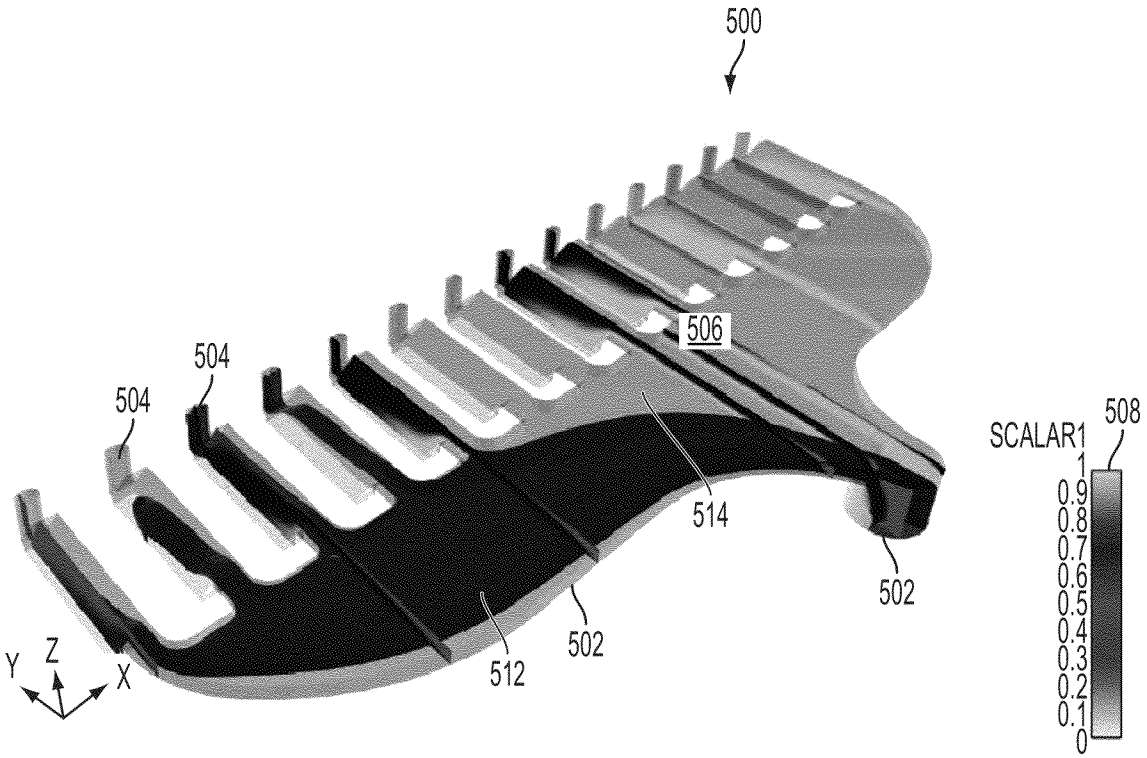
FIG. 5 is a three-dimensional graph of computational fluid dynamics modeling result of a flow path according to an example embodiment.

In FIG. 5, a generally planar passageway 506 includes a single inlet port 502 and a plurality of delivery ports 504 that feed ink to individual jets. The different shadings (shown in legend 508) represent relative concentration of particles. Dark region 512 has a high concentration of particles relative to region 514. The simulation was performed for one quadrant of the circular inlet port 502, and it is expected results to be symmetric on the other half of the passageway 506.

As the results shown in FIG. 5 illustrate, particles in a laminar, planar flow migrate along predictable paths. For example, due to sedimentation in the reservoir before port 502, particles enter inlet port 502 in the lower two quadrants. As a result, trap features placed in region 512 (either on planar surfaces or edge walls) may collect more particles than traps placed in region 514, and the parameters of the trap features (e.g., number, size, shape) may be adjusted accordingly. In reference now to FIG. 6, a perspective sectional view illustrates an example of trap features on a planar distribution manifold flow path 600 according to an example embodiment. The manifold flow path 600 may include a second portion that is symmetric about section plane 609, and may include an enclosing top plane (not shown) parallel to planar flow surface 601.

Figure 6:
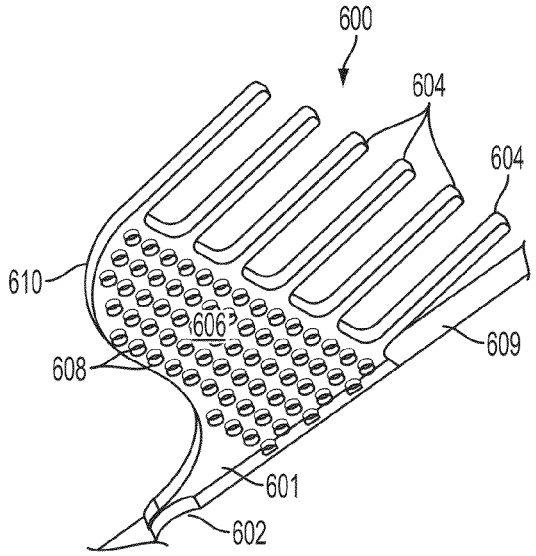
FIG. 6 is a perspective view of a flow path with planar wall particle traps according to an example embodiment.
Figure 7:
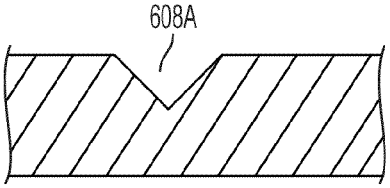
FIGS. 7-10 are cross sectional views of trap shape profiles according to example embodiments.
Figure 8:
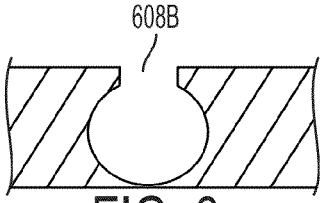
Figure 9:
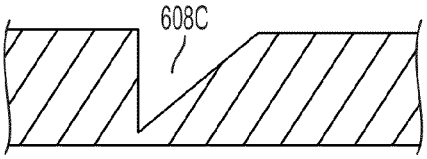
Figure 10:
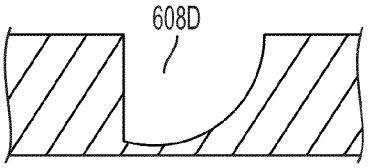

In FIG. 6, a generally planar passageway 606 includes a single inlet port 602 and a plurality of delivery ports 604 that feed ink to individual jets. As with the example in FIG. 5, this passageway 606 distributes flow over an expanding planar shape. A plurality of traps 608 are formed as depressions in a planar surface 601 of the passageway 606. The traps 608 are shown as cylindrical shaped pits in the surface 601, although alternate shapes may be used, such as shapes 608A-608D shown in FIGS. 7-10. The traps 608 may vary based on location. For example, traps 608 near outer sidewall 610 may be larger, deeper, and/or more numerous than traps 608 near the section plane 609. The traps 608 may include or be proximate to voids through the planar surface 601 that facilitate flushing particles from the traps 608, e.g., into a holding chamber or adjacent flow path.

Figure 11:
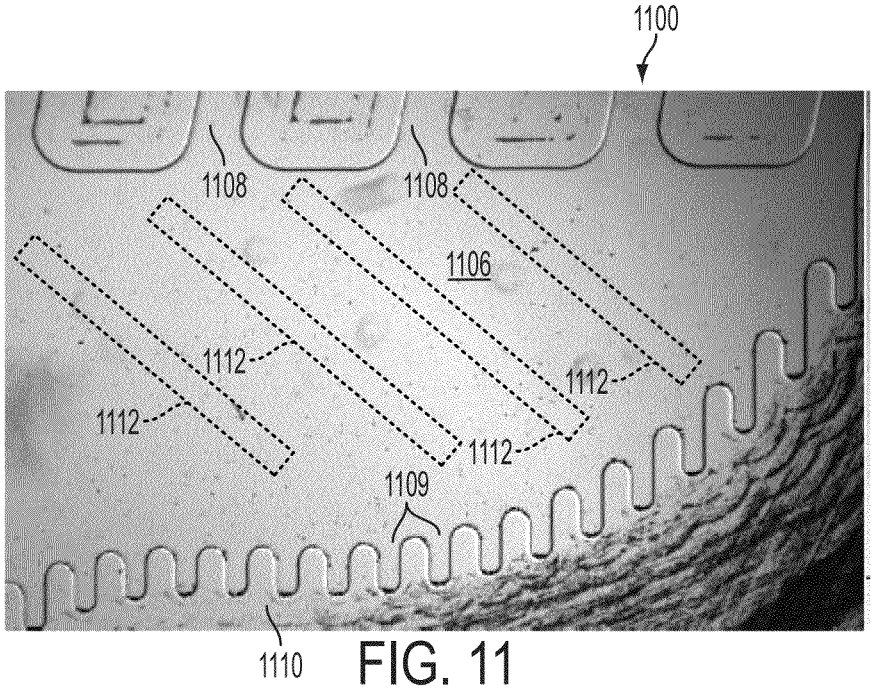
FIGS. 11-12 are a plan views of a flow path with edge wall particle traps according to an example embodiment.
Figure 12:
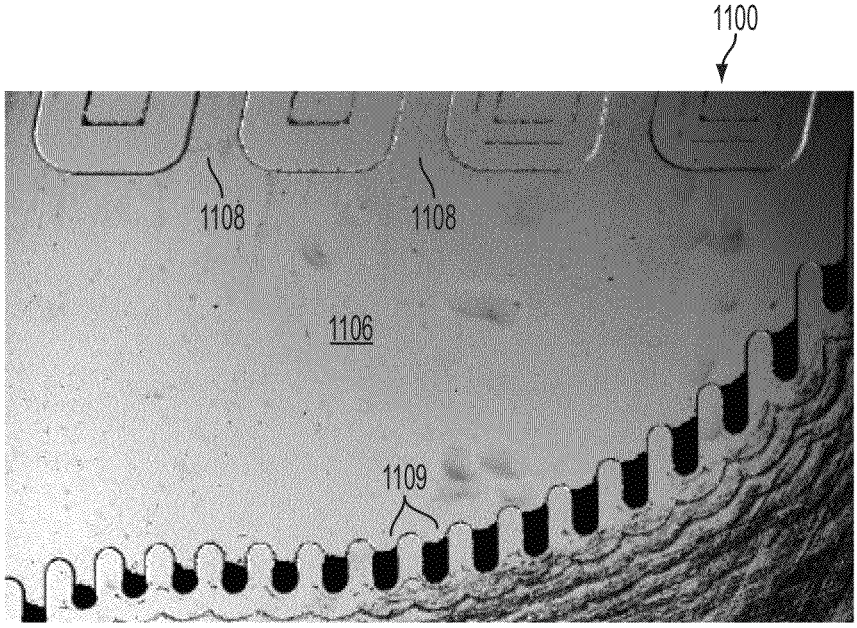
Figure 13:
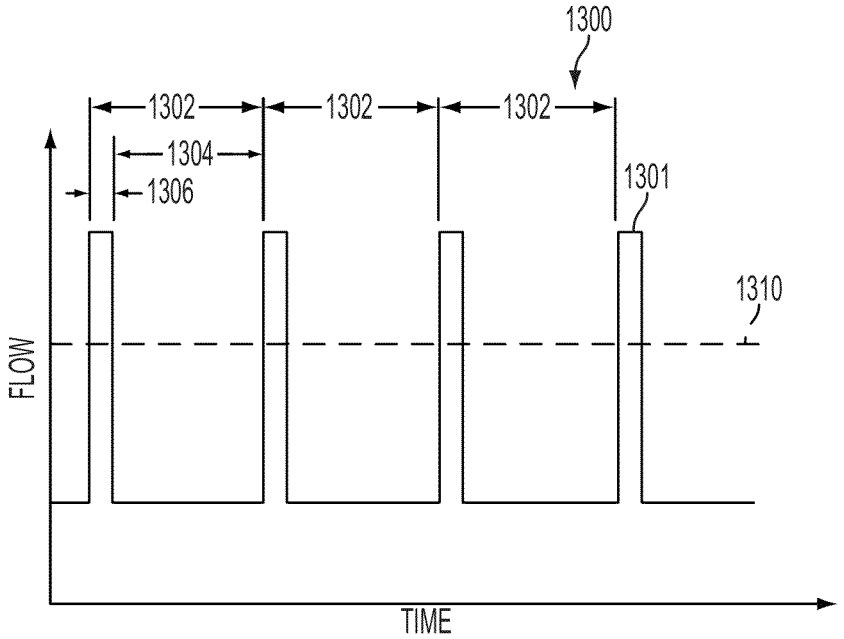
FIG. 13 is a graph of a pulsed flow cycle according to an example embodiment.

In FIGS. 11 and 12, a plan view illustrates an example of trap features on a planar distribution manifold flow path 1100 according to an example embodiment. The flow path 1100 is similar to the paths shown in FIGS. 5 and 6, having a passageway 1106 that delivers fluid from an inlet port (not shown) on the lower left of the view to distribution passages 1108 that lead to delivery ports (not shown). A sidewall 1110 of the passageway 1106 has a plurality of traps 1109, here configured as U-shaped depressions. In FIG. 12, the traps 1109 are shown full of trapped particles.

The traps 1109 may have shapes that are different than those shown here, such as shapes 608A-608D shown in FIGS. 7-10. The traps 1109 may vary in width and/or depth depending on expected concentration and/or size of particles in a particular region. As shown in FIG. 11, additional optional guiding features 1112 may be included on a planar surface of the passageway 1106. These guiding features 1112 may be configured as shown in FIG. 4, e.g., protruding slightly out of the plane of the page into passageway 1106. The location and orientation of the guiding features 1112 may vary based on expected orientation of the manifold pathway 1100 with respect to gravity, and other particulars of the flow and expected particle sizes.

As previously described, a cleaning cycle may a pulsed flow that includes one or more repetitions of a high-flow that facilitates moving the particle contaminants to the trap, and a low-flow that facilitates the particle contaminants being held in the trap. The pulsed flow may be induced by a controller that induces a pressure on the ink via jets and/or another pressure transducer located upstream or downstream from the manifold flow path. In FIG. 12, a graph 1300 illustrates an example flow profile that may be seen in a cleaning cycle according to an example embodiment.

The vertical axis of the graph 1300 indicates a flow rate through a manifold flow path, and the horizontal axis represents time. Curve 1301 represents a representative cleaning cycle having multiple individual cycles 1302. As seen in the leftmost cycle 1302, each cycle 1302 may include a first duration 1306 of high-flow and a second duration 1304 of low-flow. During the first duration 1306, the particles are pushed downstream a relatively short distance, e.g., enough to dislodge the particles from crevices but not so much as to cause the particles to overshoot traps.

During the second duration 1304 the particles are allowed to settle under the influence of gravity and/or from momentum induced during the previous duration 1306. For example, if centripetal forces cause a particle to begin moving towards a sidewall during duration 1306, then the particle may have enough momentum to continue moving towards the sidewall during duration 1304. It will be appreciated that the amount of flow during duration 1304 may be zero, but is not required to be so. For example, a small forward or reverse flow may facilitate settling/trapping particles during duration 1304.

Because the high-flow during duration 1306 may have more influence on particles than gravity/momentum during duration 1304, the duration 1304 may be substantially greater than (e.g., ten times or more) duration 1306. In one tested configuration, duration 1306 was 0.5 seconds, and duration 1304 was 120 seconds. The number of repetitions of the cycle 1302 may be selected based on context (e.g., whether cleaning is post manufacturing or user-initiated, device age) and particulars of the flow (e.g., ink viscosity and temperature). In the above-noted tested configuration, the cycle 1302 was repeated 20 times.

The maximum flow values shown on curve 1301 may be the same as or higher than a typical operational flow. For example, curve 1310 may represent a mean, steady-state flow rate during printing operations. Because printing involves activating a continually changing number of jets, there may be significant variation from this average value 1310. In some cases, the printing device may be able to provide a higher flow during cleaning than during operation, e.g., by opening additional pathways that are not opened during operation to increase flow rate. In other configurations, the maximum value of curve 1301 may be equal to a maximum operational flow, e.g., operational flow with all jets activated.

While curve 1301 is represented as a regular square wave, many variations are possible in view of these teachings. For example, one or both of durations 1304, 1306 may be changed for subsequent cycles. This may facilitate a first phase of relatively longer high-flow durations 1306 to more effectively dislodge particles, followed by one or more subsequent phases of shorter high-flow durations 1306 (or longer low-flow durations 1304) to facilitate settling the particles into traps. The curve 1301 may have other shapes, e.g., triangular, smooth, etc., to induce a desired flow. The shape of curve 1301 may be selectably altered based on device context (e.g., whether cleaning is post manufacturing or end-user-initiated, device age) and particulars of the flow (e.g., type of ink, temperature).

Figure 14:
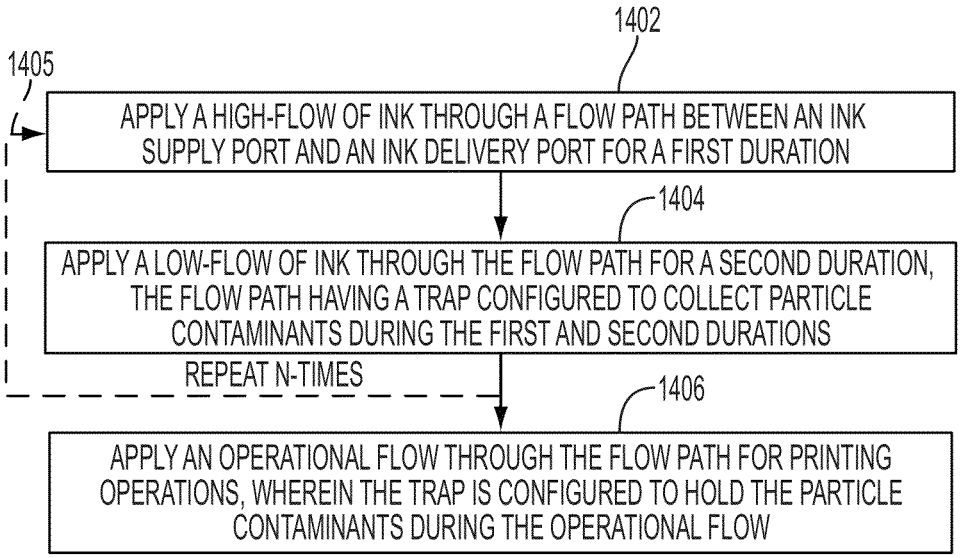
FIG. 14 is a flowchart showing a procedure according to an example embodiment.

In reference now to FIG. 14, a flowchart illustrates a procedure according to an example embodiment. The procedure involves applying 1402 a high-flow of ink through a flow path between an ink supply port and an ink delivery port for a first duration. A low-flow of ink is applied 1404 through the flow path for a second duration. The flow path has a trap configured to collect and hold particle contaminants during the first and second durations. The high- and low-flow applications 1402, 1404 may optionally be repeated n-times as indicated by path 1405 (n=0 . . . m). Thereafter, an operational flow is applied 1406 through the flow path for printing operations. The trap is configured to hold the particle contaminants during the operational flow.

The foregoing description of the example embodiments has been presented for the purposes of illustration and description. It is not intended to be exhaustive or to limit the embodiments to the precise form disclosed. Many modifications and variations are possible in light of the above teaching. Any or all features of the disclosed embodiments can be applied individually or in any combination are not meant to be limiting, but purely illustrative. It is intended that the scope of the invention be limited not with this detailed description, but rather determined by the claims appended hereto.

What is claimed is:

1. An apparatus, comprising:

an inkjet manifold comprising:

at least one ink supply port coupled to an ink supply;

at least one ink delivery port; and a flow path between the ink supply and ink delivery ports, the flow path comprising a trap comprising a first feature configured to facilitate collection of particle contaminants in response to a pulsed cleaning flow of ink and a second feature different from the first feature and configured to hold the collected particle contaminants during an operational flow of ink, wherein a relative density between the particle contaminants and ink causes the particle contaminants to collect in the trap, and wherein the pulsed cleaning flow comprises a high-flow that facilitates moving the particle contaminants to the trap and a low-flow that facilitates the particle contaminants settling into the trap, and wherein a duration of the low-flow is substantially greater than a duration of the high-flow.

2. The apparatus of claim 1, further comprising one or more elongated ridges disposed along a direction of flow between the ink supply and ink delivery openings, each of the one or more elongated ridges comprising a trapping member at a downstream end of the elongated ridge.

3. The apparatus of claim 2, wherein the trapping member comprises a cupped member.

4. The apparatus of claim 1, wherein the flow path of the inkjet manifold is substantially planar, and wherein the trap comprises one or more depressions in a planar surface of the flow path.

5. The apparatus of claim 1, wherein the flow path of the inkjet manifold is substantially planar, and wherein the trap comprises one or more depressions in an edge wall between two planar surfaces of the flow path.

6. The apparatus of claim 5, further comprising a void through the edge wall that facilitates flushing of the trap.

7. The apparatus of claim 5, further comprising a guide structure protruding into the flow path upstream from the one or more depressions, the guide structure directing the particle contaminants to the one or more depressions.

8. The apparatus of claim 1, wherein the high-flow and low-flow are repeated as part of a cleaning cycle.

9. The apparatus of claim 8, wherein the cleaning cycle is performed during a final stage of manufacture or distribution of the apparatus.

10. The apparatus of claim 8, wherein the cleaning cycle is performed during use of the apparatus by an end user.

11. The apparatus of claim 1, further comprising at least one jet coupled to the ink delivery opening of the inkjet manifold.

12. The apparatus of claim 1, wherein the first feature comprises a sedimentation length of the flow path over which particle contaminants can be collected by the trap.

13. The apparatus of claim 1, wherein the trap comprises a plurality of trapping features and the first feature comprises a distance between adjacent trapping features.

14. The apparatus of claim 1, wherein the second feature comprises a width, a height or a depth of the trap.

15. The apparatus of claim 1, wherein the first and second features are features of common structure of the trap.

16. The apparatus of claim 1, wherein the first and second features are features of disparate structures of the trap.

17. The apparatus of claim 1, wherein the trap comprises a plurality of trapping features differing in terms of one or more of a size, a shape, a depth or a density based on location of the traps on the manifold.

18. An apparatus, comprising:

an inkjet manifold comprising:

at least one ink supply port coupled to an ink supply;

at least one ink delivery port; and a flow path between the ink supply and ink delivery ports, the flow path comprising a trap comprising a first feature configured to facilitate collection of particle contaminants in response to a pulsed cleaning flow of ink and a second feature different from the first feature and configured to hold the collected particle contaminants during an operational flow of ink, wherein a relative density between the particle contaminants and ink causes the particle contaminants to collect in the trap and wherein the trap comprises a plurality of trapping features and the first feature comprises a distance between adjacent trapping features.

19. An apparatus, comprising:

an inkjet manifold comprising:

at least one ink supply port coupled to an ink supply;

at least one ink delivery port; and a flow path comprising at least one passageway between the ink supply and ink delivery ports, the flow path comprising a trap comprising a first feature configured to facilitate collection of particle contaminants in response to a pulsed cleaning flow of ink and a second feature different from the first feature and configured to hold the collected particle contaminants during an operational flow of ink, wherein a relative density between the particle contaminants and ink causes the particle contaminants to collect in the trap, and wherein the pulsed cleaning flow comprises a high-flow that facilitates moving the particle contaminants to the trap and a low-flow that facilitates the particle contaminants settling into the trap, and wherein a duration of the low-flow is maintained for a duration that causes the particle contaminates to sink by a sedimentation distance equal to a height of the passageway.

* * * * *